US009227780B2

(12) United States Patent
Krohn

(10) Patent No.: US 9,227,780 B2
(45) Date of Patent: Jan. 5, 2016

(54) STORAGE APPARATUS

(75) Inventor: Mark Krohn, Ningi (AU)

(73) Assignee: Pentair Flow Services AG, Schaffhausen (CH)

( * ) Notice: Subject to any disclaimer, the term of this patent is extended or adjusted under 35 U.S.C. 154(b) by 321 days.

(21) Appl. No.: 13/574,180

(22) PCT Filed: Jan. 20, 2010

(86) PCT No.: PCT/AU2010/000048

§ 371 (c)(1),
(2), (4) Date: Oct. 22, 2012

(87) PCT Pub. No.: WO2011/088493

PCT Pub. Date: Jul. 28, 2011

(65) Prior Publication Data

US 2013/0037140 A1 Feb. 14, 2013

(51) Int. Cl.

| | |
|---|---|
| ***B65G 53/36*** | (2006.01) |
| ***B65D 88/30*** | (2006.01) |
| ***B65D 88/32*** | (2006.01) |
| ***B65D 88/54*** | (2006.01) |
| ***E21B 21/01*** | (2006.01) |

(52) U.S. Cl.

CPC ..... *B65D 88/30* (2013.01); *B65D 88/32* (2013.01); *B65D 88/54* (2013.01); *E21B 21/01* (2013.01); *Y10T 137/85938* (2015.04)

(58) Field of Classification Search

USPC ..... 406/146, 181, 183, 38, 120; 137/595, 137/625.18; 414/303; 220/23.83

See application file for complete search history.

(56) References Cited

U.S. PATENT DOCUMENTS

| | | | | |
|---|---|---|---|---|
| 3,607,620 | A * | 9/1971 | Carlsmith | 162/37 |
| 3,861,286 | A * | 1/1975 | Albright et al. | 99/327 |
| 4,411,295 | A * | 10/1983 | Nutter | 141/59 |
| 5,381,839 | A * | 1/1995 | Dowd | 141/242 |
| 6,003,332 | A * | 12/1999 | Foster | 62/601 |
| 6,220,790 | B1 * | 4/2001 | Schenk et al. | 406/3 |
| 6,659,693 | B1 * | 12/2003 | Perkins et al. | 406/62 |
| 6,698,989 | B2 * | 3/2004 | Snowdon | 414/137.1 |
| 6,702,539 | B2 * | 3/2004 | Snowdon | 414/137.1 |
| 6,709,216 | B2 * | 3/2004 | Snowdon | 414/137.1 |
| 6,709,217 | B1 | 3/2004 | Snowdon | |
| 6,776,561 | B1 * | 8/2004 | Yeh | 406/33 |

(Continued)

FOREIGN PATENT DOCUMENTS

| | | |
|---|---|---|
| CN | 2427380 | 4/2001 |
| GB | 1356894 A | 7/1973 |

(Continued)

*Primary Examiner* — Joseph Dillon, Jr.

(74) *Attorney, Agent, or Firm* — Quarles & Brady LLP

(57) ABSTRACT

Storage apparatus includes a supporting base (11) supporting silos (14) having a lower conical portion (15) and silo port (16) controlled by an outlet knifegate valve (17), and a charging port (20) controlled by an inlet knifegate valve (21). An upper portion (22) of the silo is closed by a domed top (18). The silo ports (16) are manifolded to a common outlet (not shown). A charge manifold (25) interconnects the respective upper charging ports (20) and connects the ports to the cuttings source conduit (26). A pressure/vacuum port (27) is connected via cycle control valve (30) to an ejector assembly (not shown) valved to be able to cycle between a vacuum phase and a pressure phase of about 16 psig using a compressed air source. Control means is selectively operable to control the outlet valve (17), inlet valve (21) and cycle control valve (30).

19 Claims, 2 Drawing Sheets

(56) References Cited

U.S. PATENT DOCUMENTS

| | | | | |
|---|---|---|---|---|
| 6,843,633 | B2 * | 1/2005 | Pfeiffer | 414/304 |
| 7,278,811 | B1 * | 10/2007 | Yielding et al. | 414/139.4 |
| 8,074,509 | B2 * | 12/2011 | Bingham et al. | 73/152.18 |
| 8,348,556 | B2 * | 1/2013 | Hilgraf et al. | 406/123 |
| 8,425,160 | B2 * | 4/2013 | Curle | 406/123 |
| 8,529,160 | B2 * | 9/2013 | Ambriz | 406/174 |
| 2008/0196942 | A1 * | 8/2008 | Bingham et al. | 175/46 |
| 2009/0000184 | A1 * | 1/2009 | Garwood | 44/307 |
| 2009/0220324 | A1 | 9/2009 | Curle | |
| 2010/0015020 | A1 * | 1/2010 | Pelly | 422/234 |
| 2010/0051624 | A1 * | 3/2010 | Finn et al. | 220/560 |
| 2014/0158431 | A1 * | 6/2014 | Anderson et al. | 175/57 |

FOREIGN PATENT DOCUMENTS

| | | | |
|---|---|---|---|
| GB | 1358694 | A | 7/1974 |
| WO | 2006/037186 | A1 | 4/2006 |
| WO | 2009/018599 | A1 | 2/2009 |

* cited by examiner

STORAGE APPARATUS

FIELD OF THE INVENTION

This invention relates to storage apparatus. This invention has particular application to cuttings capture, storage and transfer apparatus for handling drill cuttings on rigs and platforms, and for illustrative purposes the invention will be described with reference to this application. However we envisage that this invention may find use in other applications such as bulk handling of particulates and non-homogeneous mixtures generally.

BACKGROUND OF THE INVENTION

The reference to any prior art in this specification is not, and should not be taken as, an acknowledgement or any form of suggestion that the referenced prior art forms part of the common general knowledge in Australia.

The disposal of drill cuttings from rigs and platforms at sea has come under increasing regulation on environmental grounds. The challenge is to accumulate cuttings on board and tranship to shore for ultimate disposal. Typically drill cuttings are accumulated in generic crane-hoistable skips which are loaded on to boat or barge for transport ashore. The number of skips required is large due to lifting limitations. Cranes are weather-dependent in operation, meaning drilling must cease when cuttings capacity on board is reached. The large number of skips necessary is an encumbrance on deck space and skips may not be safe to stack.

One solution proposed has been to use bulk pneumatic silos to handle drill cuttings as is done with other bulk materials such as barite or cement. However, traditional silos are not usually suitable, as the unique and highly variable physical properties of drill cuttings in many cases limits the ability to adequately discharge these tanks.

Traditionally the challenge of discharging high moisture and viscous materials from bulk silos was solved by having high angle conical bottoms in pressure silos. While this approach has been proven to work in most cases, this approach creates limitations in the storage capacity of the tank in a set footprint. One solution proposed by Halliburton is to have a straight sided tank with a "honey comb base" (HCB™) comprising an array of high-angle polygonal pyramids or cones dividing flow into an array of invert-conical or polygonal-pryramid outlets. The HCB tank does not rely on a high angle conical bottom to ensure mass flow discharge and can hold approximately 20% more bulk material in the same footprint as a high angle conical bottomed silo. The disadvantage is that such large tanks cannot be subjected to pressure-and-vacuum cycles necessary for efficient charge and discharge.

SUMMARY OF THE INVENTION

In one aspect the present invention resides broadly in storage apparatus including:

- a supporting base;
- a plurality of silos supported on said supporting base, each silo having a lower portion converging on a silo port controlled by an outlet valve, and an upper charging port controlled by an inlet valve; and
- a charge manifold interconnecting the respective inlet ports and connecting the ports to a flowable material source.

The supporting base may comprise a crane-hoistable supporting frame. The footprint of the supporting base may be selected to conform to a standard size such as an ISO container footprint. Alternatively the footprint may be selected to conform to the footprint of a prior art cuttings storage tank, or a defined load space on board or on transfer means such as a barge.

In yet a further embodiment the footprint may conform to the end of an ISO container and the vertical faces may describe an ISO container shape, whereby the apparatus may be turned on to the appropriate side for shipping and handling as a container. To this end the supporting base may include an open crane-hoistable frame formed by welding frame members to standard steel container corner lifting point castings.

The plurality of silos are preferably supported in a close packed array on the supporting base to get as close as possible to the density of the prior art single silo or HCB apparatus. The plurality of silos may comprise a plurality of individual, round or polygonal-sectioned silos having a generally vertical axis and constant cross section transverse the axis. Alternatively the plurality of silos may be formed by internal partitioning of a single outer silo casing. For example the silo casing may be square in section and divided by vertical partitioning into 4 equilateral-sectioned silo portions.

Preferably the silos are of a curved wall section to resist pressure and vacuum cycles while keeping the weight of construction down. The upper portion of the silo may be closed by a domed top to reduce deformation in pressure and vacuum cycles.

The lower portion is preferably of a relatively high angle of repose selected according to the material to be stored and pumped out. The convergence on the silo port is preferably smooth and without other impediment for material to pass under gravity to the port. The lower portion may for example be, or transition to be, a substantially conical lower portion. Gravity discharge may also be facilitated by the conical bases being able to be swung open.

The outlet valve may be of any valve suitable for use with the stored material. In the case of at least drill cuttings the outlet valve may be a knifegate valve. The silo ports may be siamesed or manifolded downstream of the outlet valves to provide one or more delivery conduits from the apparatus The upper charging port may pass though the upper side wall of the silo or may pass through the upper closure of the silo. The inlet valve may be of any valve suitable for use with the stored material. In the case of at least drill cuttings the inlet valve may be a knifegate valve. The upper charging ports will generally draw from a single cuttings supply and accordingly there is provided a charge manifold interconnecting the respective inlet ports and connecting the ports to the cuttings source.

The cuttings source may comprise a buffering hopper mounted above the silos and feeding with gravity assistance. Alternatively the cuttings source may comprise a pumped source such as those including a pump such as that disclosed in one or both of WO/2009/018599 and WO/2006/037186, hereby incorporated by reference.

The silos may be adapted to provide for both capture and transfer of drill cuttings. To this end the apparatus may be provided with active means for charging and discharging the material. For example there may be provided a pressure/vacuum port located at an upper position in each silo. There may be provided air supply means operable to selectively apply pressure or vacuum to each of the pressure/vacuum ports. The ports may be supplied with vacuum or pressure simultaneously, in tandem or individually on demand.

For example, the pressure/vacuum port may be connected to an ejector assembly of the type including a venturi for generating vacuum using high velocity compressed air and valved to be able to cycle to a pressure phase using the same compressed air source. The air supply means is accordingly an industrial air source of greater than 90 psig and preferably above 150 psig may be provided and down regulated as required.

There may be provided control means selectively operating the outlet valve and inlet valve. The control means may be selected to operate on one or more programmable cycles or may comprise a manually operable interface. The control means preferably controls the preferred pressure/vacuum port via an ejector assembly operated by the air supply means. The configuration and control is preferably selected to allow for several options in both load and discharge modes of operation. Preferably the tanks are rated for full vacuum and 16 psi discharge pressure. Because of the preferred high angle of repose the silos can also discharge their contents via gravity, under vacuum or via pressure along with any combination of these.

The inlet manifold and preferred outlet manifold allows one tank to be loaded whilst another is being discharged. As a consequence of the independence of operation of the silos, the apparatus can be used for the storage of for example bulk drilling mud or fluids while processing cuttings. There could be two tanks holding bulk base chemicals or diesel whilst the others are filling, storing or discharging drill cuttings. The manifold may also allow for transfer between adjacent "pods" of silos as each apparatus may form a module of a modular system that is scalable in situ.

While apparatus in accordance with the foregoing will give away some capacity in volume relative to the monolithic prior art on pure geometric grounds, there are numerous advantages that outweigh the volume shortfall. The system can store different products at the same time; the prior art storages must have the contents removed to change.

The "pods" of silos can be craned and then trucked horizontally via standard shipping container mounts.

BRIEF DESCRIPTION OF THE DRAWINGS

The invention will be described with reference to the following non-limiting embodiment of the invention as illustrated in the drawings and wherein.

Figure 1:
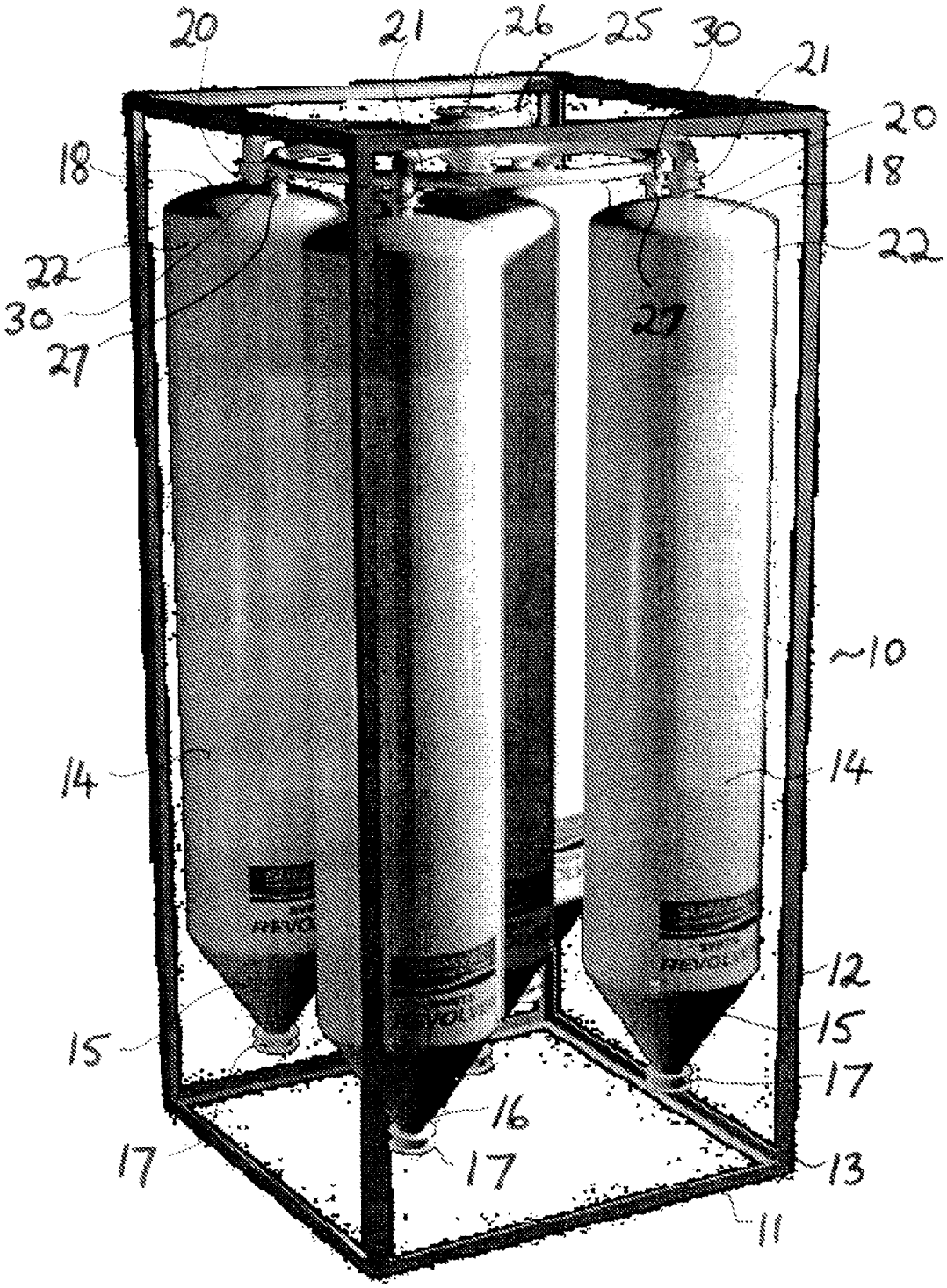
FIG. 1 is a perspective view of apparatus in accordance with the present invention.
Figures 2, 3:
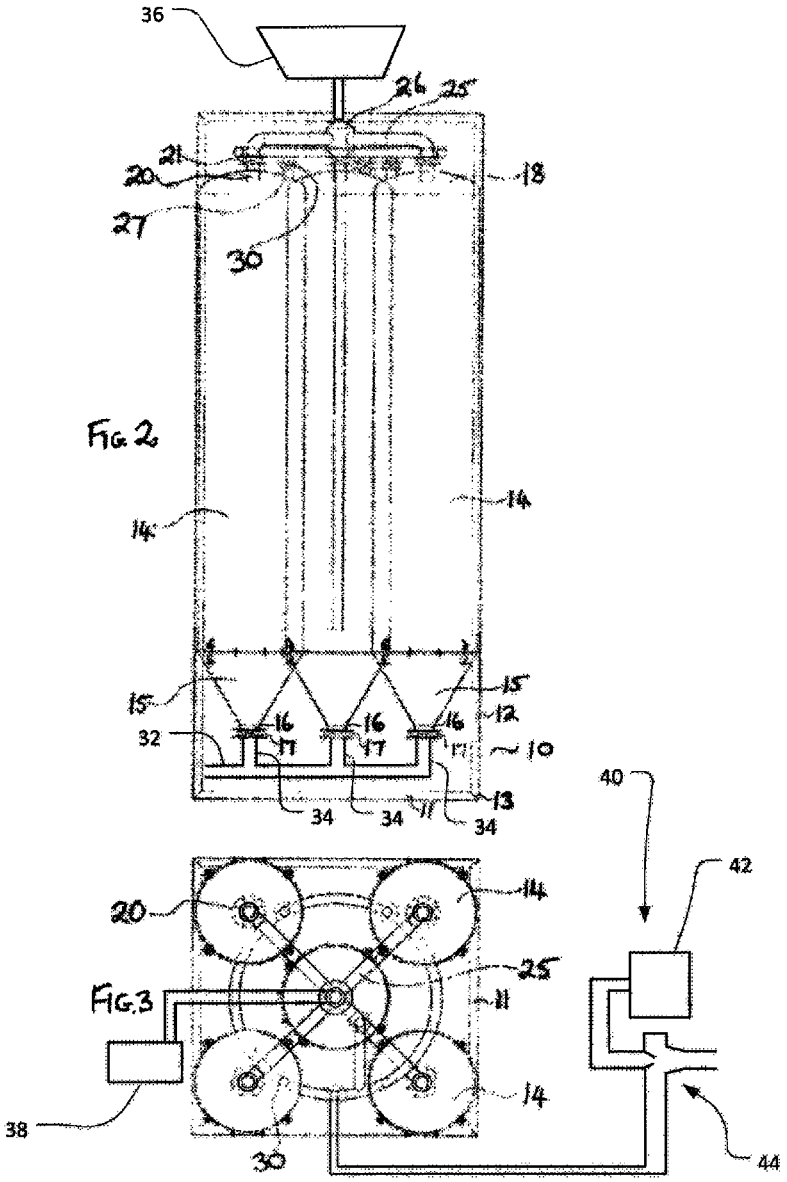
FIG. 2 is an elevation of the apparatus of FIG. 1, with a cuttings source configured as a hopper.
FIG. 3 is plan view of the apparatus of FIG. 1, with a cuttings source configured as a pumped source.

In the figures there is illustrated storage apparatus including a crane-hoistable supporting frame 10 incorporating a supporting base portion 11. The footprint of the base portion 11 conforms to the end of an ISO container and the vertical faces describe an ISO container shape. The supporting base 11 and frame 10 comprises an open frame formed by welding frame members 12 to standard steel container corner lifting point castings 13.

Five silos 14 of circular section are supported on the supporting base 11, each silo 14 having a lower portion 15 converging on a silo port 16 controlled by an outlet valve 17, and an upper charging port 20 controlled by an inlet valve 21. The silos 14 are in a close packed array on the supporting base to get as close as possible to the density of the prior art single silo or HCB apparatus.

An upper portion 22 of the silo is closed by a domed top 18 to reduce deformation in pressure and vacuum cycles. The lower portion 15 is a substantially conical lower portion and has an angle of repose of about 65° selected to accommodate discharge of drilling cuttings.

The outlet valve 17 is a knifegate valve. The respective silo ports 16 are manifolded to a common pod outlet 32 via respective outlet branches 34 downstream of the outlet valves 17.

The upper charging port 20 passes through the domed top 18 of the silo. The inlet valve 21 is a knifegate valve. A charge manifold 25 interconnects the respective upper charging ports 20 and connects the ports to the cuttings source conduit 26.

The upper charging port 20 may pass though the upper side wall of the silo or may pass through the upper closure of the silo. The upper charging ports will generally draw from a flowable material source. The flowable material source may be configured as a single cuttings supply such as a buffering hopper 36 mounted above the silos and feeding with gravity assistance, or a pumped source 38.

The silos 14 are adapted to provide for both capture and transfer of drill cuttings by selective application of pressure and vacuum to the interior of the silo 14. A pressure/vacuum port 27 is located through the domed top 18. The pressure/vacuum port is connected via cycle control valve 30 to an ejector assembly 40 of the type including a venturi 44 for generating vacuum using high velocity compressed air from a compressed air source 42 and valved to be able to cycle to a pressure phase to about 16 psig using the same compressed air source 42.

Control means (not shown) is selectively operable to control the outlet valve 17 and inlet valve 21 on selectable program cycles, and manually operable cycles. The control means controls the cycle control valve 30 and thus the ejector assembly.

Apparatus in accordance with the foregoing embodiment offers several advantages from lower build cost right through to being a significantly more functional piece of equipment. A 12.75 $m^3$ capacity is lower than the prior art capacity but the issues of the prior art that are overcome are crucial for the successful operation offshore. The dual manifold allows for one tank to be loaded whilst another or others are being emptied. The gravity discharge capability on all tanks is an advantage. The tanks may be loaded or unloaded by both vacuum and pressure. Pressurizing HCB tanks often bends the knifegate blades so some jam up. Different products can be accommodated in each pod. 12.75 $m^3$ of cuttings is around 25 tonnes so the pods can be transferred full to an awaiting cargo barge. Other single tanks such as SWACO employ a 65° angle of repose on their tanks so they are about 10 metres high. From an operational perspective this creates logistical difficulties to deal with.

The fact that the embodiment has 5 tanks which can all function autonomously to some degree removes the bigger issue of a single tank going down/offline. Tanks are generally employed to give continuity of drilling in poor weather. With the embodied system the operator can actually be still using one tank in a pod whilst discharging the others down to an awaiting barge in a break in the weather. This sort of small thing offers big dollar savings when a rig (without the crew or equipment) is costing 250-400,000.00 USD per day It will of course be realised that while the above has been given by way of illustrative example of this invention, all such and other modifications and variations thereto as would be apparent to persons skilled in the art are deemed to fall within the broad scope and ambit of this invention as is set forth in the claims appended hereto.

The invention claimed is:

1. A storage apparatus including:

a crane-hoistable supporting frame;

a plurality of silos supported on said supporting frame, each silo having a pressure/vacuum port, a lower portion converging on a silo port controlled by an outlet valve, and an upper charging port controlled by an inlet valve; and a charge manifold interconnecting the upper charging ports and connecting the upper charging ports to a flowable material source, the charge manifold being configured to provide a substantially equal flow of material simultaneously to each silo.

2. A storage apparatus according to claim 1, wherein the crane-hoistable supporting frame is the shape of an ISO container set on its end, whereby the apparatus may be turned on to the appropriate side for shipping and handling as a container.

3. A storage apparatus according to claim 1, wherein the plurality of silos are supported in a close packed array on the supporting base.

4. A storage apparatus according to claim 1, wherein the silos are each of generally circular horizontal cross section.

5. A storage apparatus according to claim 4, wherein the top end of the silo is closed by a domed top portion.

6. A storage apparatus according to claim 4, wherein the lower portion of at least one silo of the plurality of silos is a substantially conical lower portion.

7. A storage apparatus according to claim 1, wherein the outlet valve of at least one silo of the plurality of silos is a knifegate valve.

8. A storage apparatus according to claim 1, wherein the silo ports are manifolded downstream of the outlet valves to provide one or more delivery conduits from the apparatus.

9. A storage apparatus according to claim 1, wherein the inlet valve is a knifegate valve.

10. A storage apparatus according to claim 1, wherein the flowable material source is configured as a single cuttings supply, and the upper charging ports draw from the single cuttings supply via the charge manifold interconnecting the upper charging ports.

11. A storage apparatus according to claim 1, wherein the flowable material source is configured as a cuttings source selected from one of a hopper mounted above the silos and configured to feed the plurality of silos with gravity assistance, and a pumped source.

12. A storage apparatus according to claim 1, wherein each of the pressure/vacuum ports is located at an upper position in the corresponding silo.

13. A storage apparatus according to claim 12, wherein each pressure/vacuum port is connected to an ejector assembly including a venturi for generating vacuum using high velocity compressed air from a compressed air source.

14. A storage apparatus according to claim 1, including control means selectively operating said outlet valve and inlet valves.

15. A storage apparatus according to claim 14, wherein said control means operated said valves on one or more programmable cycles.

16. A storage apparatus according to claim 14, wherein the control means comprises a manually operable interface.

17. A storage apparatus according to claim 1, wherein the configuration and control is selected to allow for options in both load and discharge modes of operation.

18. A storage apparatus including:

a crane-hoistable supporting frame including a plurality of outer frame members;

a plurality of silos supported on the supporting frame, each silo having a lower portion converging on a silo port controlled by an outlet valve, an upper charging port controlled by an inlet valve, and a pressure/vacuum port, a first of the silos being substantially centered on the supporting frame, and at least a second and a third of the silos being disposed at least partly between the first silo and a respective one or more of the outer support members of the supporting frame;

a charge manifold interconnecting the upper charging ports and connecting the upper charging ports to a flowable material source, the charge manifold including a central hub aligned with the first silo and at least first and second charge conduits extending from the central hub to the second and third silos, respectively; and a pressure/vacuum manifold interconnecting the pressure/vacuum ports and connecting the pressure/vacuum ports to an ejector assembly.

19. The storage apparatus of claim 18, wherein the pressure/vacuum manifold includes a circular pressure/vacuum conduit interconnecting the pressure/vacuum ports of the second and third silos and an additional conduit connecting the circular pressure/vacuum conduit to the pressure/vacuum port of the first silo.

* * * * *